US008616414B2

(12) United States Patent
Ciavarella

(10) Patent No.: US 8,616,414 B2
(45) Date of Patent: Dec. 31, 2013

(54) BELLOWS FOAM DISPENSER

(75) Inventor: Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 1112 days.

(21) Appl. No.: 12/322,923

(22) Filed: Feb. 9, 2009

(65) Prior Publication Data

US 2010/0200615 A1 Aug. 12, 2010

(51) Int. Cl.
*B67D 7/76* (2010.01)

(52) U.S. Cl.
USPC ..... 222/190; 222/1; 222/207; 222/209; 222/321.7

(58) Field of Classification Search
USPC ..... 222/190, 206–215, 1, 321.2, 321.7, 222/383.1, 633
See application file for complete search history.

(56) References Cited

U.S. PATENT DOCUMENTS

| | | | | | |
|---|---|---|---|---|---|
| 4,220,264 | A | | 9/1980 | Gamadia | |
| 4,420,098 | A | | 12/1983 | Bennett | |
| 4,880,161 | A | * | 11/1989 | Wright | 239/330 |
| 5,238,156 | A | * | 8/1993 | Andris | 222/207 |
| 5,427,279 | A | | 6/1995 | Kaufman | |
| 5,439,140 | A | | 8/1995 | Meyer | |
| 5,462,208 | A | | 10/1995 | Stahley et al. | |
| 5,544,788 | A | | 8/1996 | Meyer | |
| 5,984,146 | A | | 11/1999 | Kaufman | |
| 6,409,050 | B1 | | 6/2002 | Ophardt et al. | |
| 6,601,736 | B2 | | 8/2003 | Ophardt et al. | |
| 6,672,486 | B2 | * | 1/2004 | Santagiuliana | 222/207 |
| 6,755,327 | B1 | * | 6/2004 | Hazard et al. | 222/209 |
| 7,246,723 | B2 | | 7/2007 | Santagiuliana | |
| 7,303,099 | B2 | | 12/2007 | Ophardt | |
| 7,708,166 | B2 | | 5/2010 | Ophardt | |
| 7,931,173 | B2 | | 4/2011 | Yuan | |
| 8,356,732 | B2 | * | 1/2013 | van der Heijden et al. | 222/190 |
| 2004/0149777 | A1 | * | 8/2004 | Santagiuliana | 222/190 |
| 2007/0194054 | A1 | | 8/2007 | Ganzeboom et al. | |
| 2009/0206109 | A1 | * | 8/2009 | Santagiuliana | 222/190 |
| 2010/0127018 | A1 | * | 5/2010 | Laidler et al. | 222/207 |

* cited by examiner

*Primary Examiner* — Frederick C Nicolas
(74) *Attorney, Agent, or Firm* — Calfee, Halter & Griswold LLP

(57) ABSTRACT

A foam dispenser is formed by modifying a standard reciprocating piston liquid pump having a reciprocating piston that is pressed to dispense liquid at an outlet. A holding chamber membrane surrounds the reciprocating piston and the outlet to define a holding chamber such that liquid dispensed at the outlet gathers at the bottom of the holding chamber. Pressing on the holding chamber membrane actuates the reciprocating piston liquid pump to dispense liquid into the holding chamber and also forces air and a portion of the liquid gathered in the holding chamber into an through a dispensing spout communicating with the holding chamber. The air and liquid are mixed at a foam media to create a foam product dispensed at an outlet of the dispensing spout.

20 Claims, 3 Drawing Sheets

BELLOWS FOAM DISPENSER

FIELD OF THE INVENTION

The present invention generally relates to a dispenser for foam. More particularly, the invention herein relates to a foam dispenser employing a reciprocating piston pump for a foamable liquid and an air bellows pump for air, the air and foamable liquid being joined prior to dispensing. This invention also provides a method for converting a standard reciprocating piston pump for liquid into a foam pump.

BACKGROUND OF THE INVENTION

Presently, more and more products are being dispensed as foam because the consuming public typically prefers foam products over their liquid predecessors. For example, foam soap, wherein a liquid soap is mixed with air to create a foam soap product, is quickly becoming more popular than the non-foam soap product that is simply dispensed as a liquid soap. In light of this, many different foam pumps have been designed and are now offered in the marketplace. Those of ordinary skill in the art will appreciate that the standard liquid pumps have been significantly redesigned to incorporate the air pumps necessary for advancing air to mix air with the liquid and create a foam. It is believed that the art would therefore benefit from the provision of a foam pump wherein the air pump mechanisms are simply added onto a common stock reciprocating piston liquid pump to provide a foam pump without any significant alteration of the liquid pump.

SUMMARY OF THE INVENTION

This invention provides a foam dispenser including a container retaining a foamable liquid for dispensing, and a reciprocating piston liquid pump communicating with the foamable liquid in the container. The reciprocating piston liquid pump includes a reciprocating piston having a pump outlet, and the reciprocating piston liquid pump is actuated by reciprocation of the reciprocating piston to dispense a dose of foamable liquid at the pump outlet. A holding chamber membrane surrounds the reciprocating piston and is defined by a floor, a cover, and a collapsible side wall, with the reciprocating piston liquid pump extending through the floor of the holding chamber membrane. A separation membrane is position between the reciprocating piston and the holding chamber membrane to define a holding chamber between the separation membrane and the holding chamber membrane. The separation membrane surrounds the reciprocating piston so as to permit a dose of foamable liquid dispensed at the pump outlet of the reciprocating piston to enter the holding chamber and collect on the floor. The cover is biased away from the base wall to establish an expanded volume of the holding chamber, and is movable toward the base wall to establish a compressed volume of the holding chamber. A dispensing spout has a spout inlet communicating with the holding chamber proximate the floor and extending to a spout outlet. A foam media is position in the dispensing spout between the spout inlet and the spout outlet. The foam pump is structured such that, when the cover of the holding chamber membrane is moved sufficiently toward the base wall, the reciprocating piston liquid pump is actuated and dispenses a dose of foamable liquid into the holding chamber, and, furthermore, the volume of the holding chamber decreases, forcing air and liquid into and through the dispensing spout and foam media to the spout outlet.

This invention also provides a method for making a foam pump from a liquid dispenser of the type that includes (a) a container for holding a liquid and (b) a reciprocating piston liquid pump communicating with the liquid in the container and providing a pump outlet in a reciprocating piston portion of the reciprocating piston liquid pump. With such a liquid dispenser, actuation of the reciprocating piston liquid pump is achieved by reciprocation of the reciprocating piston portion, and actuation dispenses a dose of the liquid at the pump outlet. With this understanding of the liquid dispenser, the method includes the steps of surrounding the reciprocating piston with a holding chamber membrane having a floor, a cover, and a collapsible side wall. The method further includes positioning a separation membrane between the reciprocating piston and the holding chamber membrane to define a holding chamber between the separation membrane and the holding chamber membrane. Another method step includes securing a dispensing spout to the holding chamber membrane proximate the floor, the dispensing spout having a spout inlet communicating with the holding chamber proximate the floor and extending to a spout outlet. The method finally includes positioning a foam media in the dispensing spout between the spout inlet and the spout outlet. The holding chamber membrane is sealed such that pressing the cover of the holding chamber membrane toward the floor thereof actuates the reciprocating piston liquid pump to dispense a dose of foamable liquid into the holding chamber, and the volume of the holding chamber decreases, forcing air and liquid into and through the dispensing spout and foam media to the spout outlet.

DETAILED DESCRIPTION OF ILLUSTRATIVE EMBODIMENTS

Figure 1:
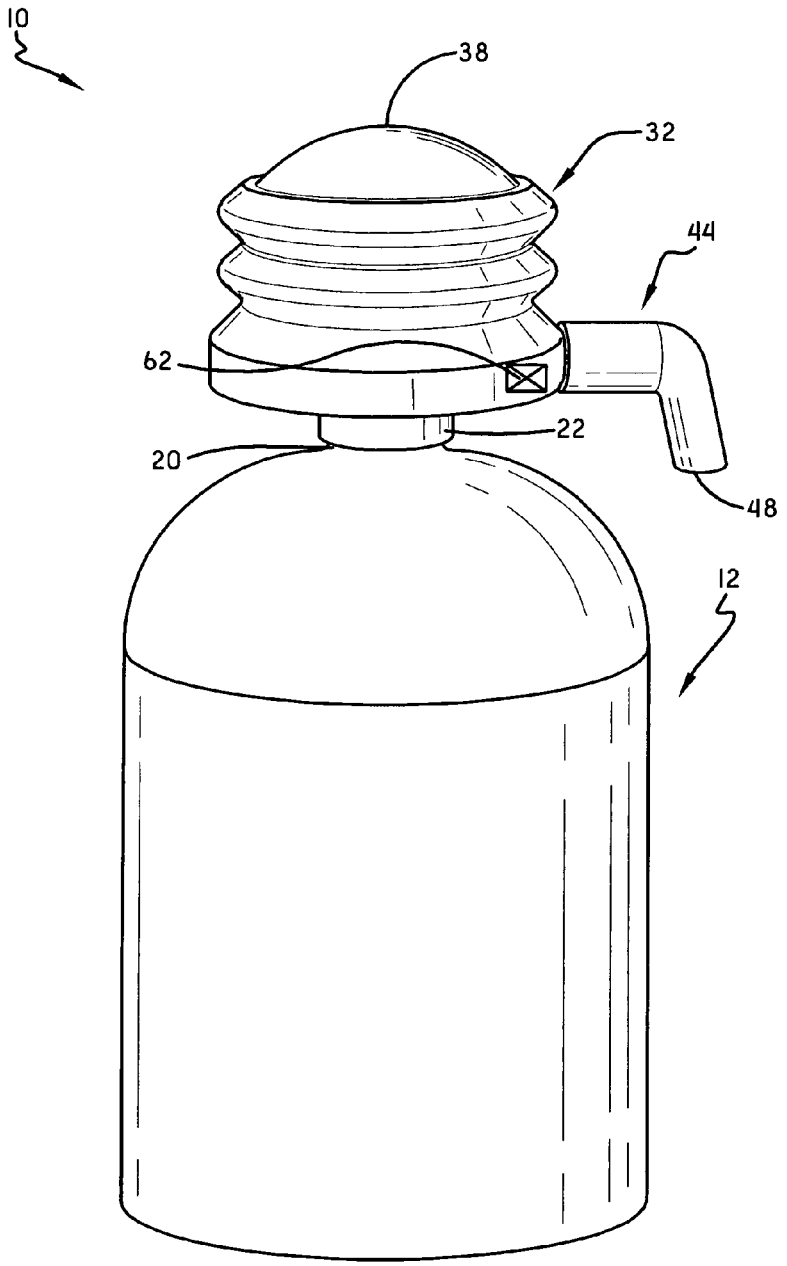
FIG. 1 is a side elevational view of a foam dispenser in accordance with this invention.
Figure 2:
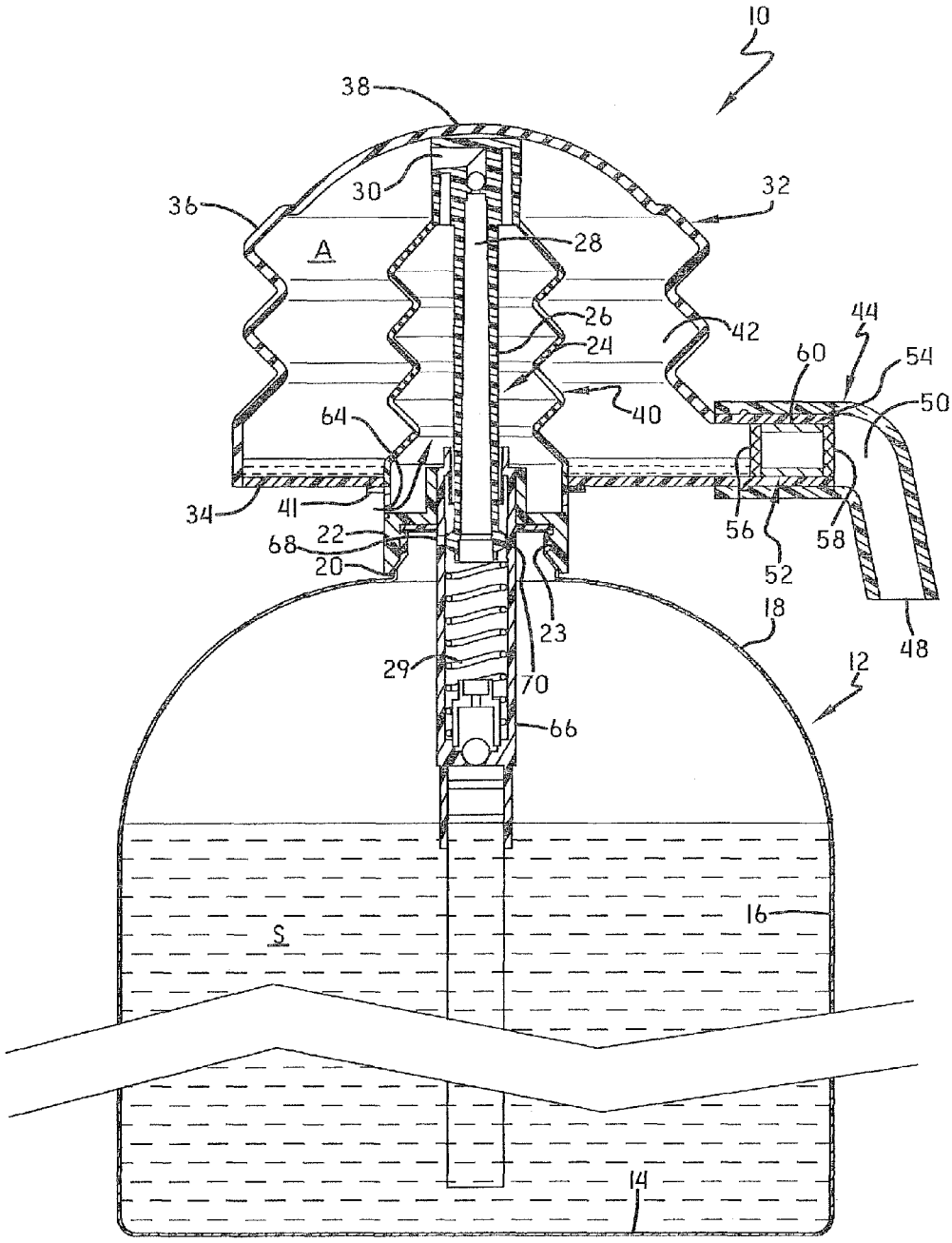
FIG. 2 is a cross sectional side view of the foam dispenser of FIG. 1, shown in an unactuated rest position.
Figure 3:
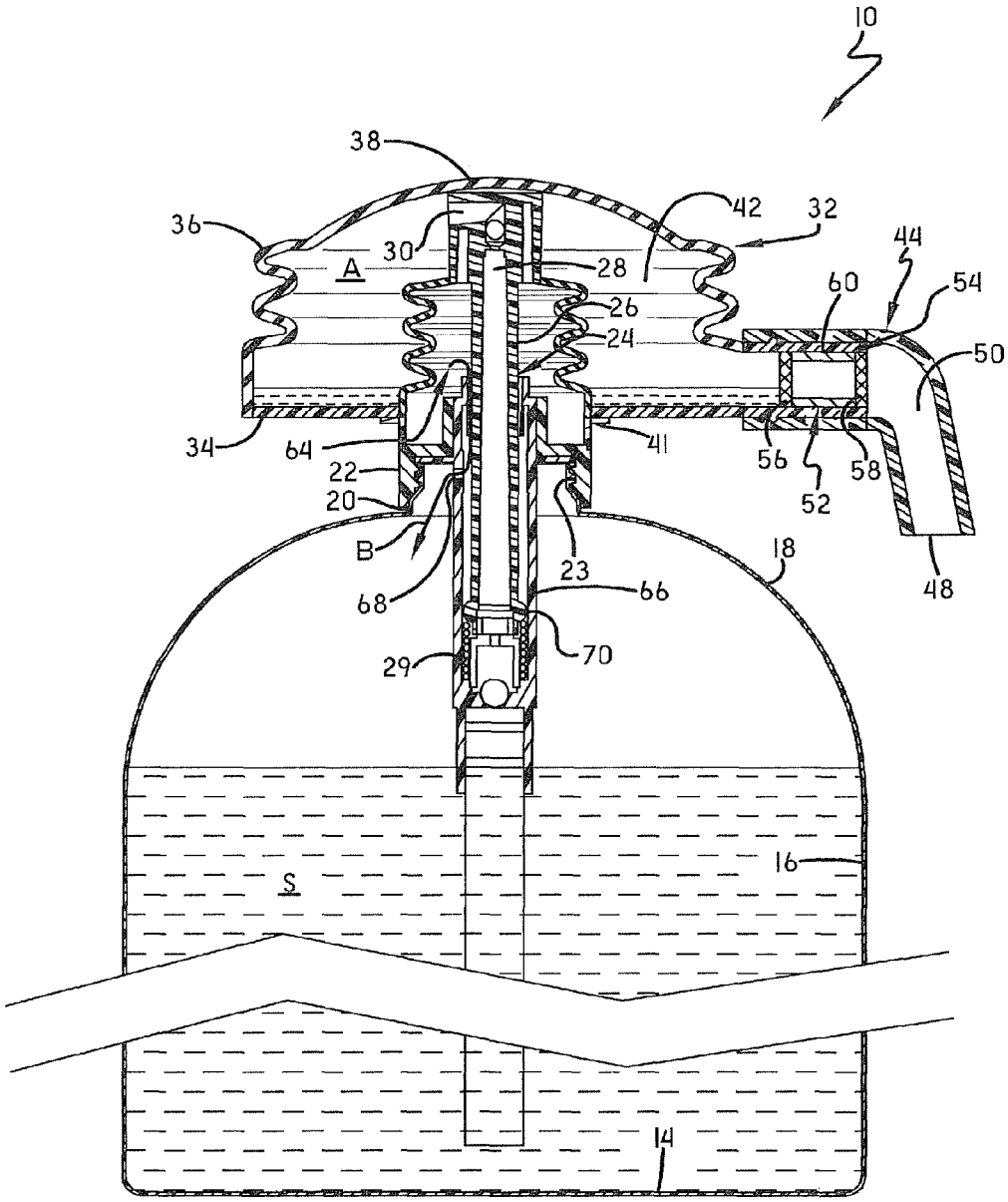
FIG. 3 is a cross sectional side view as in FIG. 2, showing the foam dispenser in an actuated state.

In FIGS. 1-3, a foam dispenser in accordance with this invention is shown and designated by the numeral 10. Foam dispenser 10 includes a container 12 having a bottom 14, a side wall 16, a shoulder 18 and a neck 20. The container 12 shown here is a rigid plastic stand-alone bottle, but, in accordance with this invention, the container 12 can take various forms and be made from various materials. A cap 22 engages the neck 20 at mating threads 23, and a reciprocating piston liquid pump 24 extends through the cap 22 to close off the open top provided by the neck 20. The reciprocating piston liquid pump 24 includes a reciprocating piston 26 having an outlet passage 28, and the reciprocating piston 26 is moved against the bias of a spring 29 to dispense the liquid S retained in the container 12. Reciprocating piston pumps are well known, and the particular structure to be employed for a reciprocating piston liquid pump 24 is not material to this invention. Indeed, a prior art reciprocating piston liquid pump and container could be employed, to be modified in accordance with this invention to provide a foam dispenser. The reciprocating piston liquid pump 24 is provided with appropriate valving, as well known, such that liquid S is dispensed at outlet 30 of the outlet passage 28 when the reciprocating piston 26 is forced downwardly. Because a foam product is desired, the liquid S is a foamable liquid.

To modify the prior art reciprocating piston liquid pump 24 to dispense foam, a holding chamber membrane 32 surrounds the reciprocating piston liquid pump 24 to provide a floor 34 for receiving a dose of liquid S when of the foam dispenser 10 is actuated. The floor 34 of the holding chamber membrane 32 transitions to a side wall 36, which, in this embodiment is a bellows sidewall. From the sidewall 36, the holding chamber membrane transitions to a cover 38. The cover 38 extends over the top of the reciprocating piston 26, in close proximity to the reciprocating piston 26, such that the top of the reciprocating piston liquid pump 24 can be actuated by pressing downwardly on the cover 38 as in FIG. 3.

A separation membrane 40 is positioned between the reciprocating piston 26 and the holding chamber membrane 32 so as to define a holding chamber 42 between the separation membrane 40 and the holding chamber membrane 32. More particularly, the separation membrane 40 is secured to the reciprocating piston 26 proximate the outlet 30 and secured to the cap 22 such that the separation membrane 40 moves with the reciprocating piston 26. In one embodiment, a radial seal is provided at the interface between the separation membrane 40 and the cap 22 such that the entire piston 26, separation membrane 40 and holding chamber membrane 32 assembly can freely rotate on or relative to the cap 22. With the structure shown, the reciprocating piston liquid pump 24 can be actuated by pressing downwardly on the cover 38, causing a dose of liquid S to be dispensed at the outlet 30 into the holding chamber 42 to collect on the floor 34. The separation membrane 40 serves to prevent this dose of a liquid S from coming into contact with the reciprocating piston 26 or other parts of the reciprocating piston liquid pump 24. The separation membrane 40 and the holding chamber membrane 32 should be structured and interact where necessary to ensure that such moving parts are separated from the liquid S. In this embodiment, a fluid-tight seal is provided between the floor 34 of the holding chamber membrane 32 and a flange 41 of the separation membrane 40, proximate the cap 22.

Notably, in this embodiment, the spring 29 not only biases the reciprocating piston 26 to an extended position with respect to the container 12, but also causes the reciprocating piston 26 to press on the cover 38 of the holding chamber membrane 32 to place the cover 38 at some distance from the floor 34. In some embodiments, a bellows sidewall (as shown) can be employed and can be formed so as to provide some of the return force to this rest position. In this biased rest position, the holding chamber 42 establishes an expanded volume, and it will be appreciated that pressing on the cover 38 toward the floor 34 causes the side wall 36 to collapse so that the holding chamber 42 assumes a compressed volume as seen in FIG. 3. When the holding chamber 42 is caused to assume its compressed volume the reciprocating piston liquid pump 24 is caused to dispense a dose of liquid S onto the floor 34 of the holding chamber membrane 32. As a result, a pool of liquid collects on the floor 34, and, during actuation of the foam dispenser 10 the air A within the holding chamber 42 is pressurized due to the collapsing of the holding chamber volume, and the air A and the liquid S are both forced into the dispensing spout 44 that communicates with the holding chamber 42.

More particularly, the dispensing spout 44 includes a spout inlet 46 communicating with the holding chamber 42 proximate the floor 34. This spout inlet 46 communicates with a spout outlet 48 through a spout outlet passage 50, and foam media 52 is positioned in the spout outlet 50 between the spout inlet 46 and the spout outlet 48. The foam media 52 can be any media suitable for mixing air and foamable liquid to create a foam product, and will typically be a screen or mesh member or open cell foam member. The foam media 52 is placed in the spout outlet passage 50 so that the air A and the liquid S forced through the spout outlet passage 50 are suitably mixed to create a foam product to be dispensed at the spout outlet 48. Various types of foam media 52 are known in the art, and virtually any suitable foam media 52 can be employed in accordance with this invention. In a particular embodiment, the foam media 52 is a cartridge 54 having a first screen 56 spaced from a second screen 58 by a tubular side wall 60.

After the cover 38 of the holding chamber membrane 32 is pressed downwardly to the position of FIG. 3 to dispense a foam product at the spout outlet 48, the pressure on the cover 38 can be removed, and the spring 29 of the reciprocating piston liquid pump 24 will return the foam dispenser 10 to its unactuated rest position of FIG. 2. The reciprocating piston liquid pump 24 will draw liquid S from the container 12 to hold it at a position ready for dispensing upon a subsequent actuation, as is generally known with the respect to reciprocating piston liquid pumps. In one embodiment, the holding chamber 42 will be recharged with air as it expands, with the air entering the holding chamber 42 through a one way air valve 62, which can be seen in FIG. 1. In other embodiments, no one way air valve is employed, and the holding chamber 42 is recharged by drawing air up through the spout outlet 48 and the spout outlet passage 50, and this can serve to draw residual soap/foam back up the spout 44 to reduce or even prevent dripping. The container 12 receives air to replace the volume of soap removed by the reciprocating piston liquid pump 24, with the air travelling through an aperture 64 positioned in the separation membrane 40 where it communicates with the atmosphere. This air can reach the interior of the bottle 12 by first travelling between the reciprocating piston 26 and its piston housing 66 and then through the aperture 68 positioned in the piston housing 66, which communicates with the interior of the bottle 12. This is shown at air path B. Notably, the aperture 68 can be positioned so that it is covered by the bottom rib 70 on the reciprocating piston 26 when the reciprocating piston 26 is at the rest position (FIG. 2). This can keep the contents of the bottle better isolated from the general atmosphere.

In one embodiment, the holding chamber membrane 32 is sized such that the cover 38 is intended to be contacted by the palm of the hand, and the cover 38 can be rounded to provide a comfortable contact between palm and cover. Additionally, the holding chamber membrane 32 and reciprocating piston liquid pump 24 can be sized to provide large doses, e.g. from 6 to 12 milliliters, of foam. With such a construction the foam dispenser 10 can be very suitable for dispensing foam soap or degreaser formulations in industrial environments, for example, for automobile mechanics, where workers might need larger doses of soap/degreaser and might find the large cover 38 easier to manipulate than smaller actuation mechanisms of the prior art. It has been found that mechanics use such large doses in order to wash their hands and up and down their forearms. Of course, virtually any dosage could be achieved, as desired.

In light of the fact that the container 12 and the reciprocating piston liquid pump 24 can be chosen from various containers and associated reciprocating piston liquid pumps, the present invention, in a particular embodiment, provides a method for making a foam pump from a common liquid dispenser. Particularly, the liquid dispenser to be modified to provide a foam pump includes a container 12 for holding a liquid S, and a reciprocating piston liquid pump 24 communicates with the liquid S in the container 12. The reciprocating piston liquid pump 24 provides a liquid pump outlet 30 in a reciprocating piston 26 of the reciprocating piston liquid pump 24. Actuation of the reciprocating piston liquid pump 24 is achieved by reciprocation of the reciprocating piston 26, which causes a dose of the liquid S to be dispensed at the liquid pump outlet 30. This general container and reciprocating piston liquid pump combination is modified as follows.

The reciprocating piston 26 is surrounded with a holding chamber membrane 32, which is defined by a floor 34, a cover 38, and a collapsible bellows side wall 36. A separation membrane 40 is positioned between the reciprocating piston 26 and the holding chamber membrane 32 to define a holding chamber 42 between the separation membrane 40 and the holding chamber membrane 32. A dispensing spout 44 is secured to the holding chamber membrane 32 proximate the floor 34. The dispensing spout 44 includes a spout inlet 46 that communicates with the holding chamber 42 proximate the floor 34 and extends to a spout outlet 48. A foam media 52 is positioned in the dispensing spout 44, between the spout inlet 46 and the spout outlet 48. The holding chamber membrane 32 is sealed so that pressing the cover 38 of the holding chamber membrane 32 toward the floor 34 thereof actuates the reciprocating piston liquid pump 24 to dispense a dose of liquid S into the holding chamber 42, and the volume of the holding chamber 42 decreases, forcing air and liquid into and through the dispensing spout 44 and foam media 52 to the spout outlet 48. An air inlet valve 62 can be provided communicating through the holding chamber membrane 32 so that air can be drawn into the holding chamber 42 as its volume expands after actuation.

In light of the foregoing, it should be evident that the present invention advances the art of foam dispensers by providing a new pump structure useful for dispensing foam. The present invention also advances the art by providing a method for modifying existing reciprocating piston liquid pumps to convert them to foam dispensers. In order to provide a foam dispenser in accordance with this invention, the liquid S that is retained in the container 12 should be a foamable liquid. In particular embodiments, this foamable liquid will be a liquid soap or foamable sanitizer, making the foam dispenser particularly useful in a hand hygiene environment. However, this foam dispenser is not limited to or by hand hygiene practices, and virtually any foamable liquid S could be employed so long as it combines with air to create a foam product. Although only a particular preferred embodiment of this invention has been shown, it will be evident that particular alterations may be made to the structure herein and yet the concepts of this invention might be followed to provide a foam dispenser in accordance with this invention. Specifically, this invention is not to be limited to or by any particular structure disclosed herein, and the claims will serve to define the scope of this invention.

What is claimed is:

1. A foam dispenser:

a container retaining a foamable liquid for dispensing;

a reciprocating piston liquid pump having a reciprocating piston with a pump outlet, said reciprocating piston liquid pump communicating with said foamable liquid in said container, said reciprocating piston liquid pump being actuated by reciprocation of the reciprocating piston to dispense a dose of foamable liquid at said pump outlet;

a holding chamber membrane defined by a floor, a cover, and a sidewall and surrounding said reciprocating piston, said reciprocating piston liquid pump extending through said floor of said holding chamber membrane;

a separation membrane positioned between said reciprocating piston and said holding chamber membrane to define a holding chamber between said separation membrane and said holding chamber membrane, said separation membrane surrounding said reciprocating piston so as to permit a dose of foamable liquid dispensed at said pump outlet of said reciprocating piston to enter said holding chamber and collect on said floor, said cover being biased away from said floor to establish an expanded volume of said holding chamber, and movable toward said floor to establish a compressed volume of said holding chamber;

a dispensing spout having a spout inlet communicating with said holding chamber proximate said floor and extending to a spout outlet;

a foam media in said dispensing spout between said spout inlet and said spout outlet, wherein, when said cover is moved sufficiently toward said floor, said reciprocating piston liquid pump is actuated and dispenses a dose of foamable liquid into said holding chamber, and the volume of said holding chamber decreases, forcing air and foamable liquid into and through the dispensing spout and foam media to said spout outlet.

2. The foam dispenser of claim 1, wherein said container includes an opening sealed by a cap, said reciprocating piston liquid pump extending through said cap to communicate with said foamable liquid.

3. The foam dispenser of claim 2, wherein said separation membrane is secured to said reciprocating piston proximate said pump outlet and secured to said cap such that said separation membrane moves with said reciprocating piston and seals said reciprocating piston liquid pump against contact with doses of foamable liquid dispensed at said pump outlet of said reciprocating piston liquid pump.

4. The foam dispenser of claim 3, wherein said floor of said holding chamber membrane is secured to said separation membrane proximate said cap.

5. The foam dispenser of claim 1, wherein said sidewall of said holding chamber membrane is a bellows sidewall.

6. The foam dispenser of claim 1, wherein said foam media is a cartridge bounded by mesh screens.

7. A method for making a foam pump from a liquid dispenser that includes (a) a container for holding a liquid and (b) a reciprocating piston liquid pump communicating with the liquid in the container and providing a pump outlet in a reciprocating piston portion of the reciprocating piston liquid pump, wherein actuation of said reciprocating piston liquid pump is achieved by reciprocating movement of the reciprocating piston portion and dispenses a dose of the liquid at the pump outlet, said method comprising the steps of:

surrounding the reciprocating piston with a holding chamber membrane having a floor, a cover and a collapsible sidewall;

positioning a separation membrane between the reciprocating piston and the holding chamber membrane to define a holding chamber between the separation membrane and the holding chamber membrane;

securing a dispensing spout to the holding chamber membrane proximate said floor, the dispensing spout having a spout inlet communicating with the holding chamber proximate the floor and extending to a spout outlet; and positioning a foam media in the dispensing spout between the spout inlet and the spout outlet, the holding chamber membrane being sealed such that pressing the cover of the holding chamber membrane toward the floor thereof actuates the reciprocating piston liquid pump to dispense a dose of foamable liquid into the holding chamber, and the volume of the holding chamber decreases, forcing air and foamable liquid into and through the dispensing spout and foam media to the spout outlet.

8. A foam dispenser comprising:

a container retaining a foamable liquid;

a reciprocating liquid pump;

a cap connected to the liquid pump for securing the liquid pump to the container;

the liquid pump having a dip tube extending into the container and a dispensing nozzle opposite the dip tube;

a holding chamber surrounding the dispensing nozzle and secured to the cap;

the holding chamber having a resilient membrane and a floor;

the holding chamber having an expanded volume and a compressed volume;

an outlet passage connected to the resilient membrane and the floor; and a foaming media located in the outlet passage.

9. The foam dispenser of claim 8 further comprising a separation membrane separating a stem of the reciprocating liquid pump from liquid dispensed from the dispensing nozzle.

10. The foam dispenser of claim 8 wherein liquid dispensed from the dispensing nozzle builds up on the floor and is forced through the foaming media and outlet passage by air pressure caused by the holding chamber moving from an expanded volume to a compressed volume.

11. The foam dispenser of claim 8 wherein the resilient membrane is in the form of a bellows.

12. The foam dispenser of claim 8 wherein the outlet nozzle opens substantially downward.

13. The foam dispenser of claim 8 wherein air may enter into the container through an aperture in the housing of the liquid pump.

14. A foam dispenser comprising:

a container retaining a foamable liquid;

a reciprocating liquid pump;

a cap connected to the liquid pump for securing the liquid pump to the container;

the liquid pump having a dip tube extending into the container and a dispensing nozzle opposite the dip tube;

a holding chamber surrounding the dispensing nozzle and secured to the cap;

the holding chamber having a resilient membrane and a floor;

the holding chamber having an expanded volume and a compressed volume;

an outlet passage connected to the floor of the holding chamber;

a foaming media located in the outlet passage.

15. The foam dispenser of claim 14 further comprising a separation membrane separating a stem of the reciprocating liquid pump from liquid dispensed from the dispensing nozzle.

16. The foam dispenser of claim 14 wherein liquid dispensed from the dispensing nozzle builds up on the floor and is forced through the foaming media and outlet passage by air pressure caused by the holding chamber moving from an expanded volume to a compressed volume.

17. The foam dispenser of claim 14 wherein the resilient membrane is in the form of a bellows.

18. The foam dispenser of claim 14 wherein the outlet nozzle opens substantially downward.

19. The foam dispenser of claim 14 wherein air may enter into the container through an aperture in the housing of the liquid pump.

20. The foam dispenser of claim 14 wherein the foaming media comprises one or more screens.

* * * * *